United States Patent [19]

Dixon

[11] 4,277,920

[45] Jul. 14, 1981

[54] PORTABLE AND OPERABLE WALL SYSTEMS

[75] Inventor: Guy E. Dixon, Miami, Fla.

[73] Assignee: Panelfold Doors, Inc., Miami, Fla.

[21] Appl. No.: 770,064

[22] Filed: Feb. 18, 1977

Related U.S. Application Data

[63] Continuation-in-part of Ser. No. 727,605, Sep. 28, 1976, Pat. No. 4,103,463.

[51] Int. Cl.[3] ..... E04B 2/74; E04H 3/02

[52] U.S. Cl. ..... 52/64; 49/321; 52/122; 52/127; 52/241

[58] Field of Search ..... 52/122, 127, 238, 241, 52/242; 49/321, 127, 130

[56] References Cited

U.S. PATENT DOCUMENTS

| | | | |
|---|---|---|---|
| 2,443,548 | 6/1948 | Wilson | 52/122 |
| 3,295,257 | 1/1967 | Douglass | 49/127 |
| 3,327,439 | 6/1967 | Eatough | 52/127 |
| 3,341,992 | 9/1967 | Piper | 52/127 |
| 3,453,789 | 7/1969 | Stephenson | 52/122 |
| 3,453,790 | 7/1969 | Harris | 52/122 |
| 3,557,499 | 1/1971 | Dickie | 52/241 |
| 3,566,559 | 3/1971 | Dickson | 52/122 |
| 3,755,968 | 9/1973 | Williams | 49/127 |
| 3,798,839 | 3/1974 | Kaufman | 49/127 |
| 4,034,524 | 7/1977 | Walther | 52/122 |

FOREIGN PATENT DOCUMENTS

| | | | |
|---|---|---|---|
| 1033880 | 7/1958 | Fed. Rep. of Germany | 52/122 |
| 675016 | 7/1952 | United Kingdom | 52/238 |

*Primary Examiner*—John E. Murtagh

*Attorney, Agent, or Firm*—Harvey B. Jacobson

[57] ABSTRACT

A portable or operable wall system utilizing wall panels defining a wall or partition extending between a floor surface and a ceiling surface with the portable wall system including wall panels which are completely separable from the ceiling surface and includes lower support means for movably supporting the panels on a floor surface to facilitate movement of the panels to a desired location. The operable wall system includes ceiling trackways which suspend the panels to enable movement to a desired location. Both wall systems include an adjustable, spring biased, inverted channel-shaped member engageable with the ceiling surface and a vertically extendible and retractable channel-shaped floor engaging member which enables the effective vertical height of the panels to be altered between an extended position in which the panels sealingly engage the floor surface and ceiling surface and a retracted position of lesser vertical dimension than the floor to ceiling height to enable the panels to be movably supported on the floor surface for movement while in generally vertical position to a desired location in the portable wall system and for suspended support from an overhead trackway for movement to a desired location in the operable wall system.

7 Claims, 10 Drawing Figures

142
144
152
150
178
176
18
154
146
134
174
132
148
28
138
160
170
162
22
166
168
158
164
156
84
86
5
116
86
94
80
98
96
114
124
110
118
82
120
119
128
76
78
122
100
126
56
54
112
44
42
40
64
60
62
30
26
102
32
38
58
66
50
68
74
108
104
36
49
72
70
52
48
16
106
5

PORTABLE AND OPERABLE WALL SYSTEMS

CROSS REFERENCE TO RELATED APPLICATION

This application is a continuation-in-part of my copending application U.S. Ser. No. 727,605, filed Sept. 28, 1976, for Portable Wall System now U.S. Pat. No. 4,103,463.

BACKGROUND OF THE INVENTION

1. Field of the Invention

The present invention generally relates to portable and operable wall systems incorporating one or more movable panels which are vertically extendible in length and provided with an adjustable, spring biased ceiling engaging member to provide an effective seal against the ceiling surface, compensate for variations and irregularities in the height of the ceiling surface and maintain a controlled resilient force against the ceiling surface to facilitate use of the wall system with various types of ceilings. The portable wall system includes floor engaging spherical rollers or casters which engage the floor surface when the vertical height of the panel has been shortened to enable the panel to be rolled along the floor surface to a desired location. The operable wall system includes a ceiling track and panel supporting mechanism in the form of a generally horizontal disk oriented in the track for suspending the panel for movement to a desired location when the panel is retracted in vertical height with the disk being movable upwardly away from the supporting surfaces of the track when the vertical height of the panel is extended to provide an effective seal with the ceiling surface and floor surface.

2. Description of the Prior Art

Movable wall systems incorporating vertical panels, partitions, room dividers, and the like, are well known. In many installations, it is desired that the wall system include a continuous wall from floor to ceiling with a seal being provided at both the floor and the ceiling with the panel or panels being readily movable from one location to another. Portable wall systems have been provided in which the panels are vertically extendible in length and provided with a floor engaging support mechanism, such as rollers, casters, and the like, with a manual device being provided for extending the vertical length of the panels to secure them in desired position. The structure for extending the vertical height of the panels introduces the capability of damage to the ceiling, especially when the panel is being installed in an enclosure having a suspended ceiling. Operable wall systems are also known in which panels are suspended from an overhead track so that when the panels are in their vertically retracted or shortened condition, the panels may be moved along the track to a desired location after which the panels are extended in length to provide a continuous partition or wall.

SUMMARY OF THE INVENTION

An object of the present invention is to provide a wall system in the form of a plurality of movable wall panels with each panel including a manually extendible and retractable floor engaging member along the lower edge thereof and a spring biased ceiling engaging member along the upper edge thereof with the spring biased ceiling engaging member including adjustment means to maintain a constant spring bias exerted thereon to compensate for variations in the ceiling height and control the force exerted on the ceiling to enable the panels to be effectively used with various types of ceilings including drop ceilings in which acoustical panels, or the like, are gravity supported in a grid work of supporting rails, channels, and the like.

In one embodiment of the invention, the wall system includes portable panels which are completely separable from the ceiling and freely rollable along a floor surface to enable relocation of the panels or positioning of the panels in a desired orientation.

In another embodiment of the invention, the wall system includes a plurality of panels which are suspended from overhead trackways incorporated into the ceiling by a structure which supports the panels above the floor surface when the panels are in their vertically retracted condition and enables contact between the lower edge of the panel and the floor and the upper edge of the panel and the ceiling or track structure when in extended position with the supporting structure which normally suspends the panel from the trackway during movement of the panel being elevated from the supporting surfaces of the trackway when the panel is vertically extended.

Another object of the invention is to provide a wall system in accordance with the preceding objects and in accordance with the two above-mentioned embodiments in which the ceiling engaging member is in the form of a channel-shaped member having parallel legs telescopically received over the upper edge of the panel and the channel includes parallel seals along each top edge portion thereof for engagement with a ceiling surface which may be in the form of ceiling panels and supporting structures or portions of the overhead supporting trackway in which the panel is provided with a guide structure interconnecting the channel and panel and adjustable spring bias structure to control the the resistance to downward movement of the channel in relation to the panel. The guide structure is in the form of a plurality of threaded rods in threaded engagement with a slide block having one end of a spring associated therewith so that the resilient characteristics of the spring and the forces exerted by the spring on the guide block may be adjusted to customize the structure and resilient characteristics of the ceiling engaging member to satisfy the requirements for each installation.

A further object of the invention is to provide a wall system in accordance with the preceding objects in which the floor engaging member is in the form of a channel having parallel legs telescopically receiving the lower edge of the panel and provided with longitudinally extending, transversely spaced multi seals on the lower edge thereof and including a manually actuated lever operating mechanism connecting the channel to the panel to move the channel to extended and retracted positions and automatically lock the channel in both positions by virtue of the specific linkage mechanism utilized.

Yet another important object of the invention is to provide a wall system in accordance with the preceding objects in which the side edges of the panels are provided with means for retaining the panels in alignment with each other and including a peripheral seal for providing complete isolation of one surface of the panel from the other and thus preventing transfer of heat, light, and sound from one side of the panel or wall to the other.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
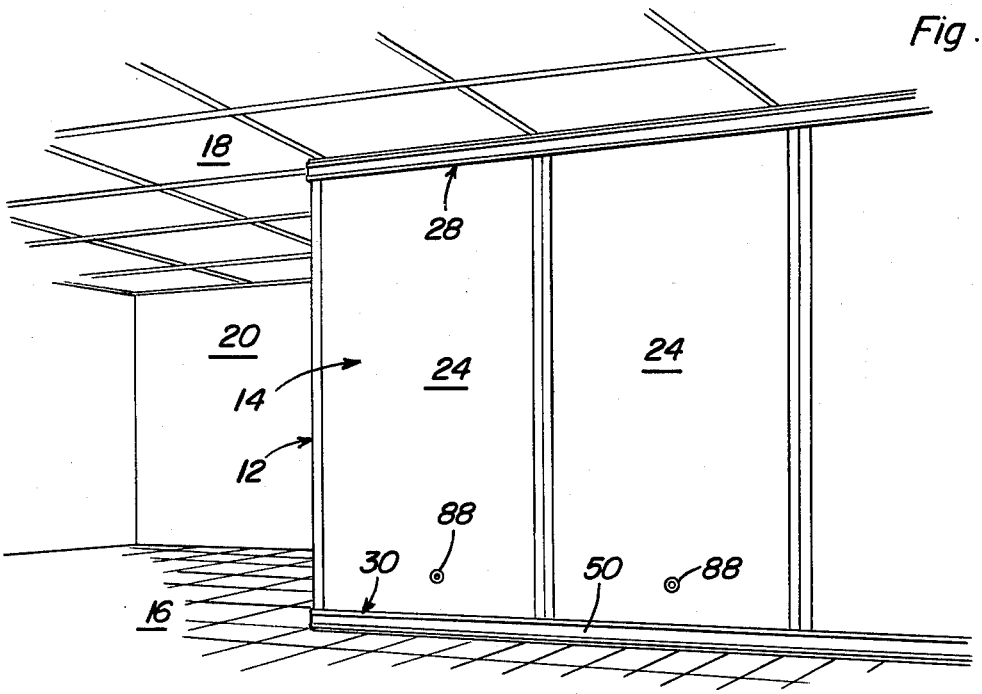
FIG. 1 is a schematic illustration of the portable wall system of the present invention installed in an enclosed space.

Referring now specifically to FIGS. 1–6 of the drawings, the portable wall system forming one embodiment of the present invention is generally designated by numeral 12 and includes a plurality of portable wall panels 14 arranged in vertical orientation and horizontal alignment to form a portable wall between a floor surface 16 and a ceiling surface 18 in order to provide a portable wall, partition, or the like, in an enclosure defined by vertical walls 20 so that the enclosed space may be divided into smaller enclosed spaces for various purposes. The wall panels 14 are constructed of any desired standard size modules and may be of various heights for installation in spaces having different height or width dimensional characteristics.

Each wall panel 14 includes a pair of planar panel members 22 and 24 disposed in spaced relation to each other and in generally parallel relation with the panel members 22 and 24 being secured to a peripheral frame 26 generally in the form of a channel-shaped extrusion, or the like. The panel members 22 and 24 may be constructed of wood, plastic, metal, or any other material used in constructing walls and wall panels and provided with any external ornamention or appearance characteristics, as desired. Various types of wall boards, laminated panels, flake board, or the like, may be used for this purpose with insulating material therebetween, if desired, with the over-all thickness of the panel 14 being varied, as desired, so that the physical characteristics of the panels 14 will be compatible with the enclosed space in which the panels are used and be capable of being moved to a desired location and handled by individuals.

The upper edge of the panel 14 is provided with a spring biased ceiling engaging member 28 generally in the form of an inverted channel in which the spring force exerted on the channel may be adjusted to be maintained constant. The bottom edge of each panel 14 is provided with a floor surface engaging member 30 which also is in the form of a channel-shaped member and is vertically extendible and retractable for sealing engagement with the floor surface 16. Also, the lower edge of the panel 14 is provided with a plurality of supporting assemblies generally designated by numeral 32 for movable supporting engagement with the floor surface 16 when the floor engaging member 30 is in retracted position with the floor engaging member 30 being vertically extended and retracted by an elevating and lowering mechanism generally designated by numeral 34.

Each supporting assembly includes a ball-type caster 36 rotatably journaled in a housing 38 fixedly supported on a bracket plate 40 by a screw threaded stud 42 with the bracket plate 40 being secured to the peripheral frame 26 by suitable screw threaded fasteners 44, or the like. A plurality of the ball-type casters 36 are provided on each panel 14 with each panel including at least two of the ball-type casters for rolling contact with the floor surface 16 to facilitate movement of the panels 14 along the floor surface to enable an individual to roll the panel 14 to a desired location when the panel has a vertical height less than the distance between the floor and ceiling.

The floor engaging member 30 includes a channel-shaped member 46 having a bight portion 48 paralleling the floor surface 16 and a pair of vertically extending parallel legs 50 which extend upwardly alongside of the lower edge portions of the panel members 22 and 24 and move telescopically in relation thereto. The bight portion 48 includes a pair of depending seal strips 52 oriented in parallel, transversely spaced relation, which are in the form of multiple blade members constructed of vinyl, rubber, or the like, for engagement with the floor surface 16 along a plurality of parallel lines of engagement. The legs 50 of the channel-shaped member 46 include an inwardly extending seal strip or sweep 54 at the upper edge thereof for sealing engagement with the external surface of the panel members 22 and 24 and enabling vertical movement of the channel-shaped member 46 in relation to the panel 14.

Figure 5:
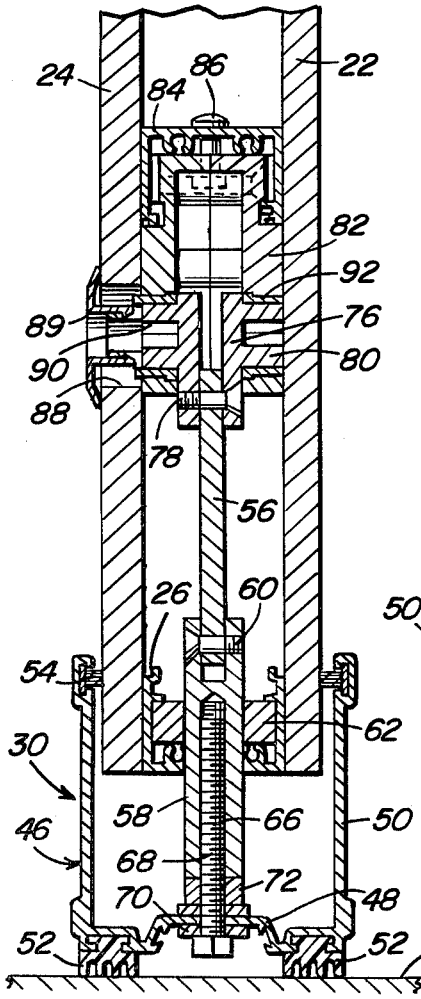
FIG. 5 is a detailed, sectional view taken substantially upon a plane passing along section line 5—5 on FIG. 4 illustrating further structural details of the actuating mechanism for raising and lowering the floor engaging member.
Figure 6:
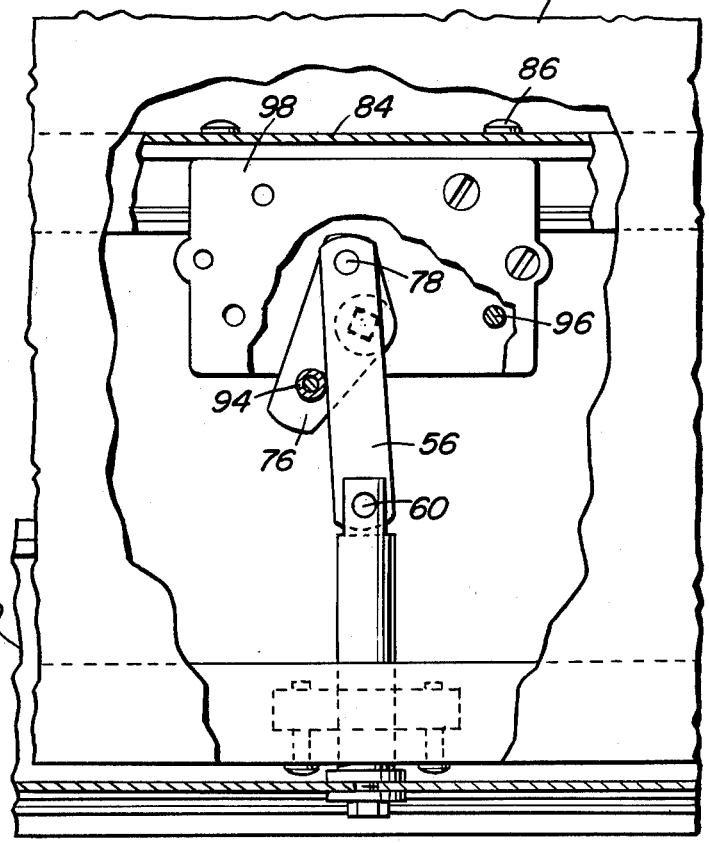
FIG. 6 is a fragmental, side elevational view, with portions broken away, illustrating further structural details of the mechanism for raising and lowering the floor engaging member.
Figure 2:
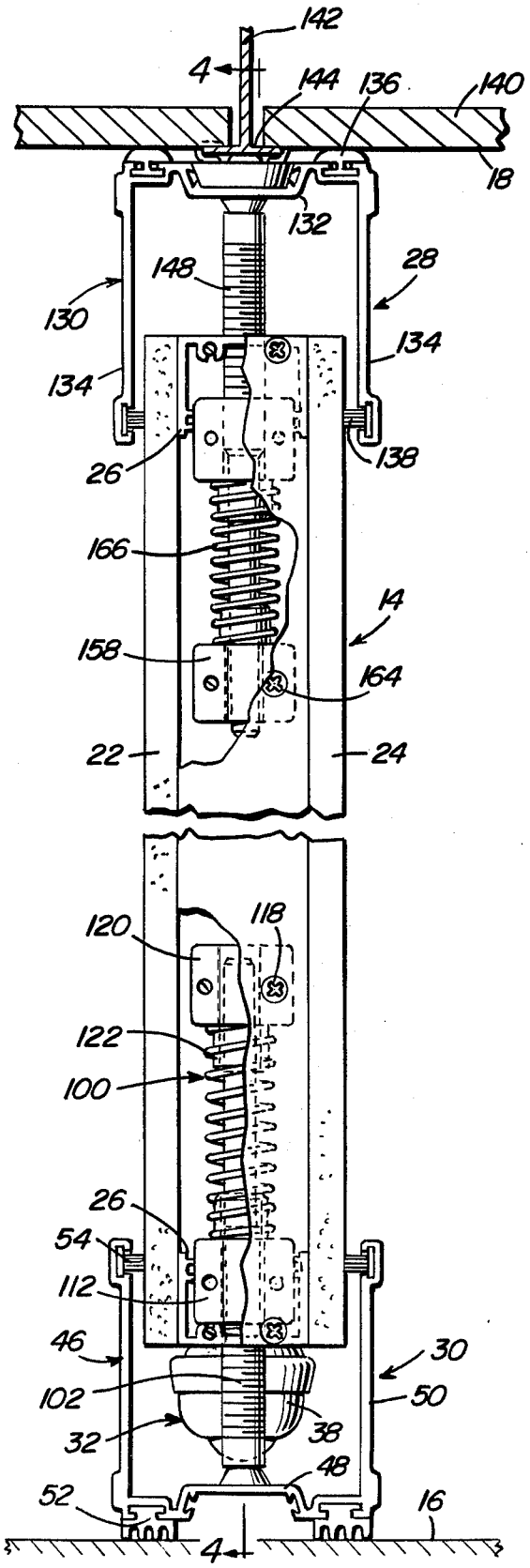
FIG. 2 is a vertical, sectional view on an enlarged scale, illustrating the structural details of a portable wall panel in its vertically extended position.
Figure 3:
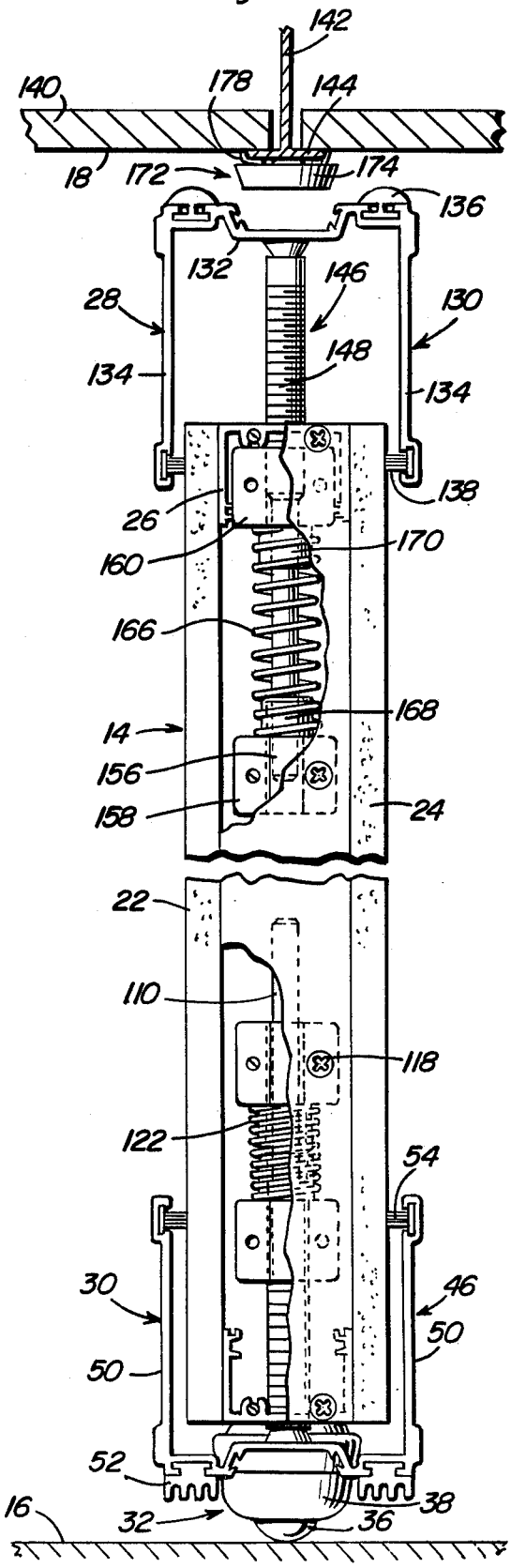
FIG. 3 is a vertical, sectional view similar to FIG. 2 but illustrating the wall panel in vertically retracted position.
Figure 4:
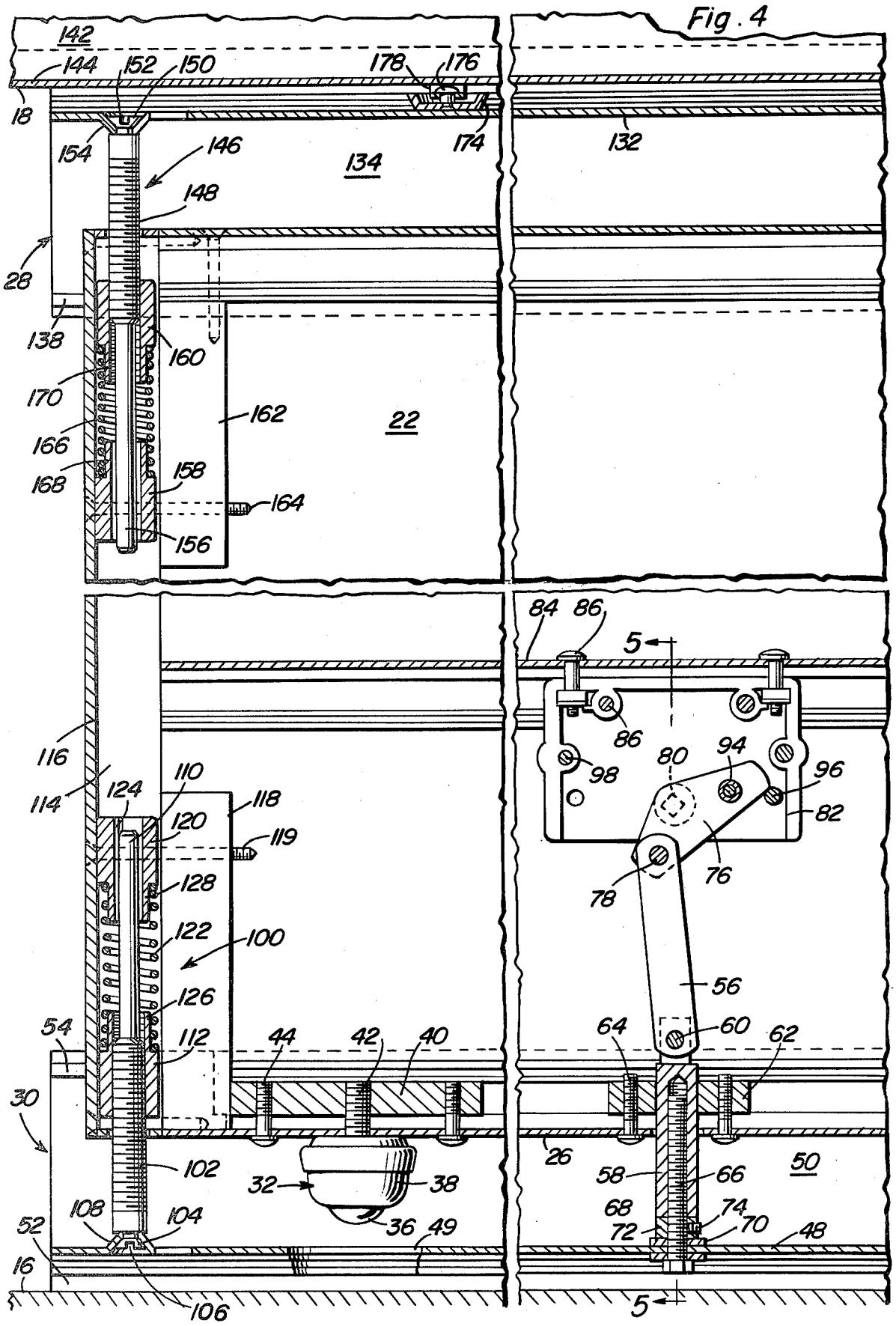
FIG. 4 is a vertical, sectional view taken substantially upon a plane passing along section line 4—4 on FIG. 2 illustrating the specific structural details of the ceiling engaging member, floor engaging member and mechanism for retracting and extending the floor engaging member.

The elevating and lowering mechanism 34 for the floor engaging member 30 includes a vertically elongated link 56 having its lower end pivotally connected to a vertically disposed guided rod 58 by a transverse pivot pin 60. The rod 58 is vertically reciprocally guided by a guide block 62 secured to the peripheral frame 26 by screw threaded fasteners 64 with the lower end of the rod 58 being connected to the bight portion 48 of the channel-shaped member 46 by an elongated threaded bolt 66 that extends up through the bight portion of the channel-shaped member 46 and threads into an internally threaded bore 68 in the rod 58, as illustrated in FIGS. 4 and 5. The bolt 66 provides an adjustment for the effective length of the rod 58 with the bolt 66 being provided with washers 70 above and below the bight portion 48 and a collar 72 with a set screw 74 therein provided for maintaining the adjusted position of the bolt 66. As the link 56 is moved with the upper end thereof moving in an arcuate path, the rod 58, bolt 66 and floor engaging member 30 will be raised and lowered with the limits of such movement being adjusted by the adjustable connection between the bolt 66 and the rod 58.

The upper end of the link 56 is connected to one corner of generally triangular sector plates 76 by a pivot pin 78 in which the plates 76 serve as a lever for movement of the link 56 when the sector plates 76 are pivoted or rotated about a center shaft or axle 80 which is supported by a supporting base 82 that is connected to a horizontal frame member 84 by screw threaded bolts or other fasteners 86. The axle or shaft 80 is supported in alignment with openings 88 in the panel members 22 and 24 defined by a grommet 89 and the axle or shaft 80 is hollow with the interior thereof being square or of other polygonal configuration, as indicated by numeral 90, to receive a square or comparably shaped drive element, such as the male output element of a wrench handle, such as found in socket wrench sets, and the like. The sector plates 76 and axle or shaft 80 are integral with each other and formed of two identical components oriented in face-to-face relationship to each other and journaled in bores 92 in the two mounting plates or bases 82, as illustrated in FIG. 5. The sector plates 76 include a pin therebetween and base 82 includes a pin 96 to limit the pivotal movement of the sector plates 76 about the axis defined by the axle or shaft 80 defined by bosses on the sector plates 76. The two base members 82 are secured in assembled relation by screw threaded fasteners 98, or the like, with this entire assembly being anchored to the frame member 84 such that the floor engaging member 30 will be retained in its retracted position and in its extended position by the abutment pins 94 and and 96 and the orientation of the pivot axis defined by the pivot pin 78, the link 56 and the rotational axis of the sector plates 76 with the two positions of the floor engaging member being on opposite sides of a vertical plane passing through the rotational axis of the sector plates 76 so that spring force exerted on the floor engaging member will retain the floor engaging member in both of its positions as the center of the pin 78 shifts to opposite sides of the rotational axis of the sector plates 76.

Each end of the floor engaging member 30 is provided with a guide assembly 100 in the form of an elongated threaded rod 102 having its lower end provided with a head 104 having a screw driver receiving kerf 106 therein and rotatably journaled in a deformed or countersunk socket 108 in the bight portion 48 of the channel-shaped member 46. The upper end portion of the threaded rod 102 is of reduced diameter and provided with a smooth external surface, as indicated by numeral 110. The threaded portion of the rod 102 is screw threaded through an internally threaded and floating guide block 112 which is movably guided in a guideway 114 defined by an edge plate 116, an internal block 118 and screw threaded fasteners 119 which also anchor an upper, rigid guide block 120 in position for reciprocally receiving the reduced end portion 110 of the threaded guide rod 102. A coil spring 122 extends between the internally threaded floating guide block 112 and the stationary guide block 120 which has a passageway 124 therethrough with the spring being telescoped over a projection 126 on the floating block 112 and a projection 128 on the stationary block 120. By engaging a screw driver with the screw driver kerf 106, the threaded guide rod 102 may be rotated, thus adjusting the floating guide block 112 towards and away from the stationary guide block 120 thereby preloading the spring 122 to a desired length so that the spring pressure exerted onto the floor engaging member 30 and thus the spring bias force engaging the floor engaging member 30 with the floor surface being adjusted so that the spring force will be substantially constant within the limits of the spring, thereby enabling variations in vertical height betwen the floor and ceiling to be compensated for while maintaining a predetermined force exerted by the panel on the floor surface and, more importantly, on the ceiling surface. The spring 122 also serves to bias the floor engaging member 30 downwardly, thus maintaining the retracted linkage in its retracted position when the pivot pin 78 is swung above and to the opposite side of the rotational axis of the sector plates 76 so that this over-center arrangement will assure that the floor engaging member 30 will be retained in retracted position during movement of the panel 14.

The ceiling engaging member 28 is in the form of an inverted channel-shaped member 130 including an uppermost bight portion 132 and a pair of depending parallel legs 134 which are spaced apart sufficiently to receive the upper edge of the panel 14 therebetween. The side edge portions of the bight portion 132 include longitudinal seal members 136 mounted thereon and the inner lower edge portions of the legs 134 also include an inwardly extending seal strip or sweep 138 thereon engaging the external surface of the panel members 22 and 24. The seals 136 engage the ceiling surface 18 which in this embodiment of the invention is a drop ceiling which includes a plurality of modular panels 140 which may be acoustical or of other suitable structure supported by a grid work of inverted T-shaped supporting strips or frame members 142 with the panels 140 merely resting on the horizontal flanges 144 which define the bottom edge of the supporting strip or frame member 142 in a conventional and well known manner so that only limited vertical pressure can be exerted on the ceiling surface 18 without damaging the ceiling or lifting the panels. The structure of the panels provides a "light" touch and maintains a constant force regardless of variations in the ceiling height as normally encountered. Of course, the panel structure may be utilized with various types of ceilings in which excessive vertical pressure exerted on the ceiling would cause damage or displacement thereof.

The ceiling engaging member 28 is vertically movably supported from the upper edge of the panel 14 by a guiding and adjusting mechanism generally designated by numeral 146 and which is similar to the guiding and adjusting mechanism connecting the floor engaging member 30 to the bottom of the panel 14. The guiding and adjusting mechanism 146 includes an elongated screw threaded rod 148 having a head 150 at the upper end thereof provided with a screw driver receiving kerf 152 and journaled in a socket 154 formed in the bight portion 132 of the channel-shaped member 130. The lower end of the screw threaded rod 148 is provided with a reduced end portion 156 which is externally smooth and received through a stationary guide block 158. The threaded portion of the threaded rod 148 is screw threadedly engaged with an internally threaded, floating guide block 160 which is vertically guided by the external wall 116 and a block 162 similar to the block 118 at the lower end of the panel with fasteners 164 securing the assembly in place. A coil spring 166 engages the blocks 158 and 160 with the block 158 having a tubular extension 168 thereon and the block 160 including a tubular extension 170 thereon telescopingly received in the remote ends of the coil spring 166. Thus, by adjusting the screw 148 by inserting a screw driver into the kerf 152, the initial position of the ceiling engaging member 28 may be adjusted. This also provides an adjustment of the force exerted by the spring 166 since it will control the necessary movement of the ceiling engaging member 28 that may be necessary to accommodate variations in ceiling height. By shortening the effective length of the spring, the force exerted on the ceiling will be maintained constant throughout the range of compression and expansion of the spring. Thus, for a particular installation, the ceiling engaging member 28 as well as the floor engaging member 30 may be initially adjusted so that only a relatively short length of the spring will be compressed when the vertical length of the panel 14 is extended which is the installed position of the portable wall. The short length of compression of the spring enables the maintenance of a constant force being exerted on the ceiling surface as compared to an arrangement where the complete length or a substantial lengthwise portion of the spring is compressed which might occur if the floor-to-ceiling height varies from one end to the other of the portable wall which is not an unusual occurrence in many buildings.

To provide lateral stability to the upper edge of the panel 14, a plurality of stabilizing buttons generally designated by numeral 172 are mounted on the horizontal flange 144 of the grid frame 142. These buttons are in the form of a frusto-conical member 174 of plastic material or any other material which are shaped to correspond with the internal hollow interior configuration of the bight portion 132 of the channel-shaped member 130. The buttons 172 include an anchor pin 176 extending upwardly through a clip 178 which is a commercially available item and involves inwardly extending flanges at the opposite ends of the longitudinal edges thereof so that the clip may be inserted up over the flange 144 and twisted to interlock with the flange 144 of the T-bar or rail 142. Thus, by providing a plurality of the buttons 172 which may be attached to the flange 144 by merely inserting them upwardly and twisting a partial turn, the portable wall system may be stabilized at its upper edge.

With the wall in assembled position, as illustrated in FIG. 1, when it is desired to relocate the wall or a portion thereof in another position, it is only necessary to insert the tool into the opening 88 and turn it in a manner to raise the floor engaging member 30 upwardly which lowers the panel 14 so that it will disengage from the ceiling surface 18 and the buttons 172 and be supported by the ball-type casters 36 so that the panel 14 may then be rolled along the floor supporting surface to its desired new location. The buttons 172 may be easily removed and replaced on the frame grid work for the suspended ceiling or additional buttons may be installed wherever desired.

Figure 7:
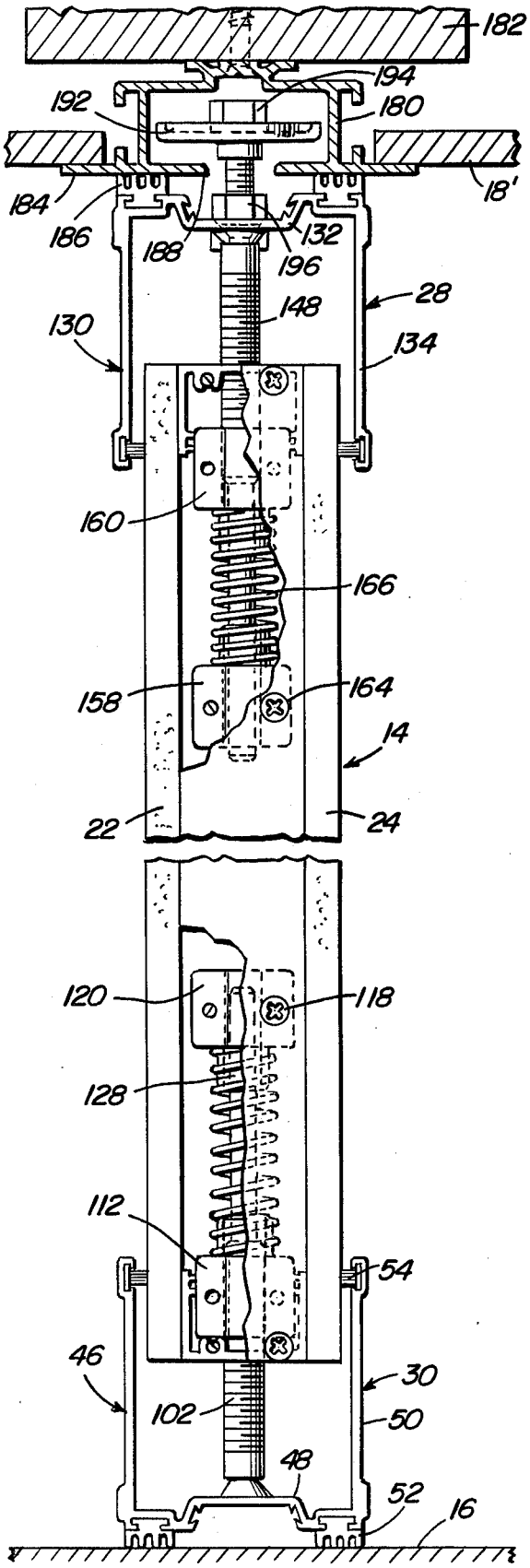
FIG. 7 is a vertical, sectional view, similar to FIG. 2, but illustrating the operable wall system with the panel in vertically extended position.
Figure 8:
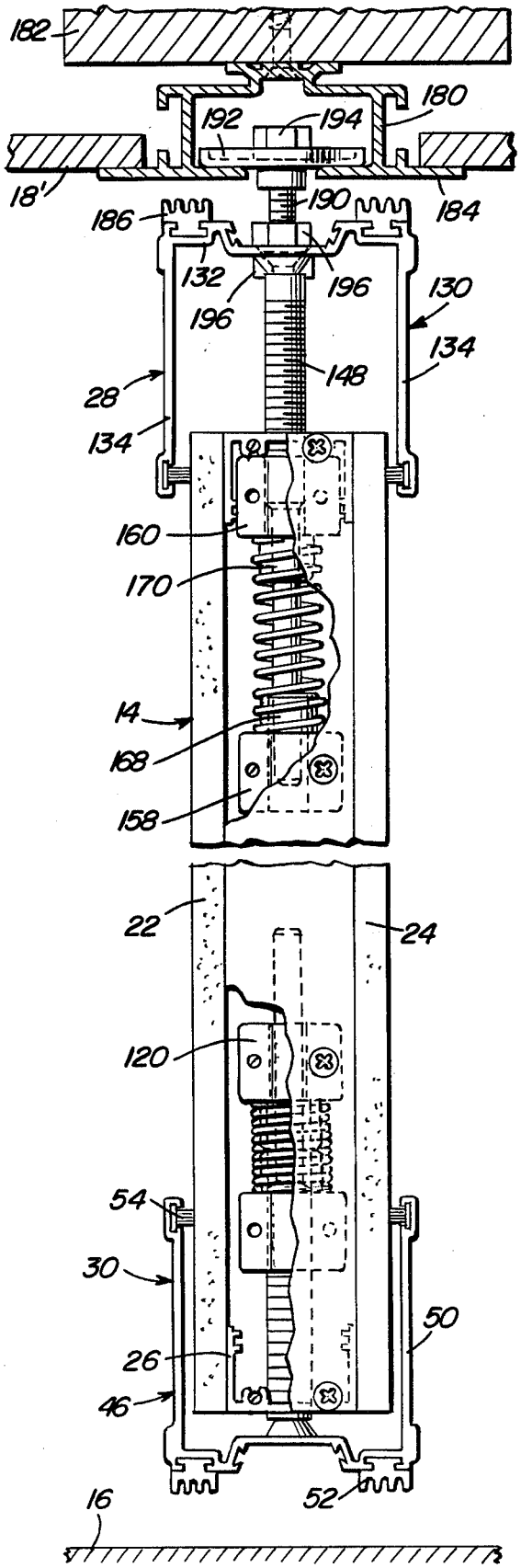
FIG. 8 is a sectional view, similar to FIG. 7, but illustrating the wall panel in vertically retracted position and supported from an overhead track.
Figure 9:
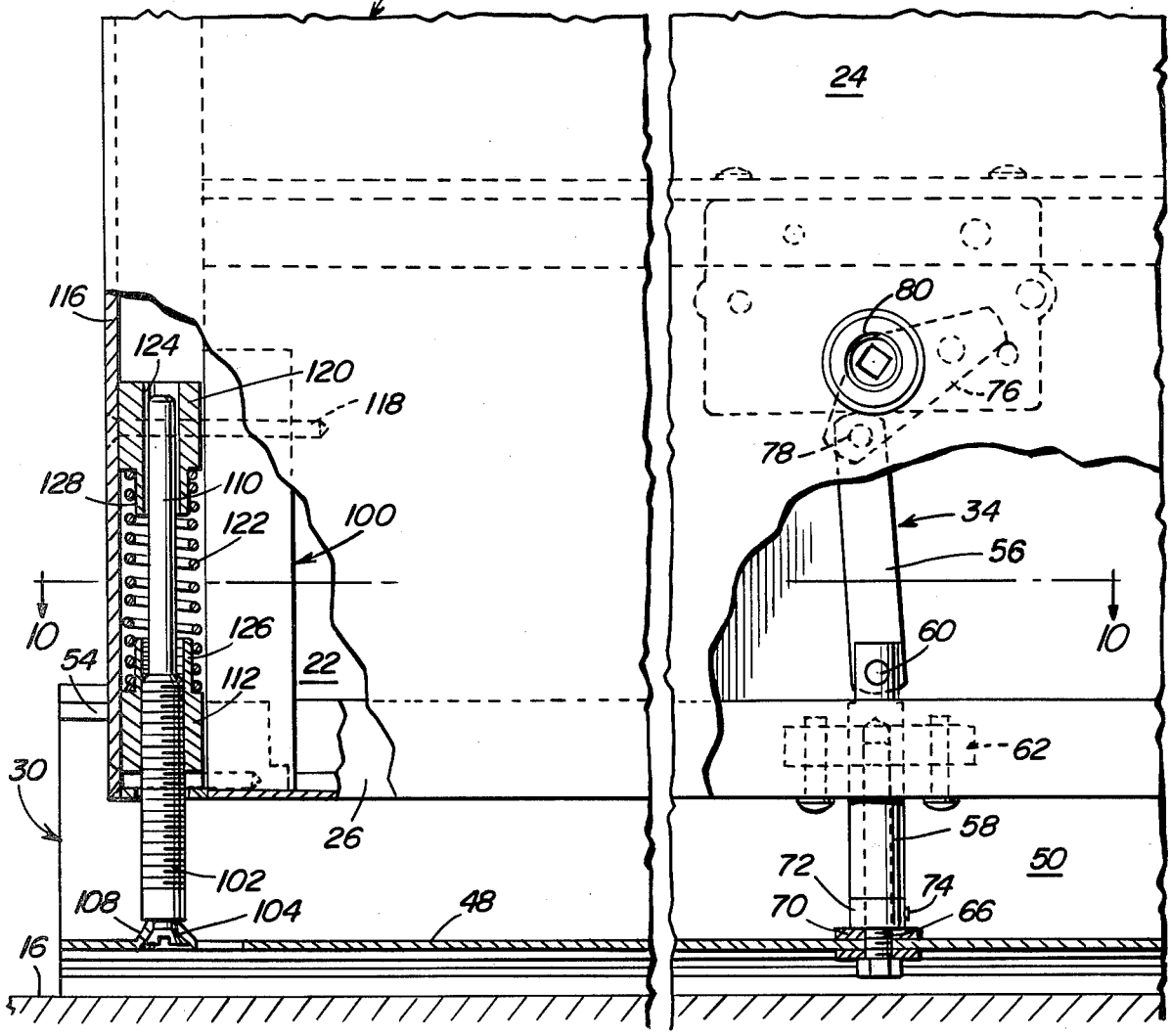
FIG. 9 is a fragmental, elevational view, with portions broken away, of the lower corner of the panel illustrating additional structural details of the floor engaging member, the spring bias guide and support structure therefor and the retracting and extending mechanism therefor.
Figure 10:
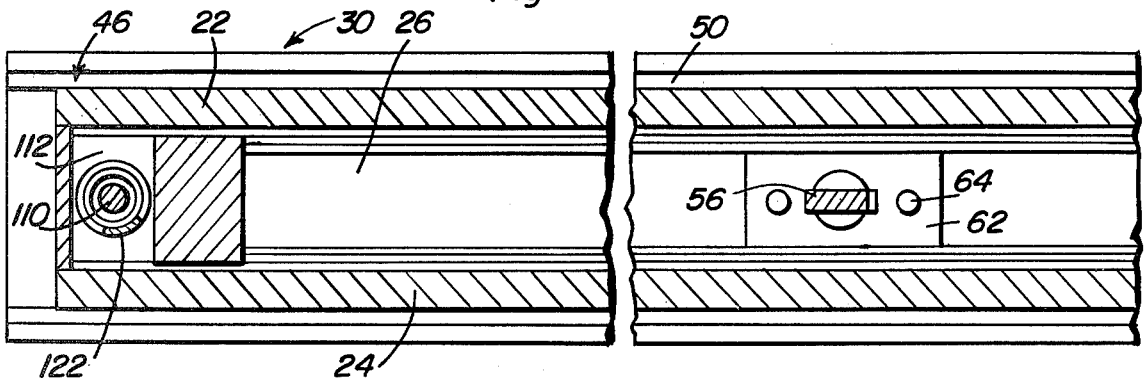
FIG. 10 is a transverse, sectional view taken substantially upon a plane passing along section line 10—10 on FIG. 9 illustrating further structural details of the device.

The second embodiment of the invention in the form of an operable wall system is illustrated in FIGS. 7–10 and the panel structure is substantially the same as that disclosed in FIGS. 1–6 except that the entire supporting assemblies 32 are omitted. Accordingly, the same reference numerals are utilized in FIGS. 7–10 to indicate identical structure. The floor engaging member 30 and the ceiling engaging member 28 are identical, except that the holes 49 which receive the supporting assemblies 32 may be omitted. In this arrangement, the ceiling surface 18' is provided with a trackway 180 that may be supported from an overhead support structure 182 in any suitable manner with the trackway 180 including horizontal bottom flanges 184 which may support the ceiling surface 18' and also provide a surface for engagement by sealing strips 186 which may be the same as those illustrated in FIGS. 1–6 or the same as the multiple bladed sealing strips 52 utilized on the floor engaging member 30. The horizontal flanges 184 terminate in spaced relation to each other, thus providing a longitudinal slot 188 receiving an adjustable supporting rod 190 therethrough which has a circular supporting disk 192 retained on the upper end thereof by a retaining nut or the like 194. The supporting rod 190 extends through the bight portion of the ceiling engaging member 28 and is anchored thereto by retaining nuts 196 and 198 oriented in such a manner that when the disk 192 is engaged with the upper surface of the flanges 184, the seal strips 186 on the ceiling engaging member 28 will be spaced downwardly from the lower surfaces of the flanges 184 as illustrated in FIG. 8 which is the condition in which the floor engaging member 30 has been elevated by the mechanism 34 and the panel 14 is suspended for movement along the trackway. By utilizing the disk 192, the panels 14 may be moved in various directions in relation to the ceiling when the trackways are disposed in angular intersecting relations as desired in any particular installation. After the panel 14 has been moved to the desired location, the elevating mechanism 34 is activated to lower the floor engaging member 30 which will increase the vertical height of the panel 14 and elevate the panel 14 so that the seal strips 186 will engage the flanges 184 and form a seal therewith in which position the disk 192 has been elevated from the flanges 184 as illustrated in FIG. 7, thus anchoring the operable wall in the desired location.

While disks 192 have been illustrated for supporting the operable wall, it is within the purview of this invention to support the operable wall with conventional rollers, wheels, or any other supporting structure may be used along with a suitable track or other overhead support.

When the operable wall is lifted off the track, it becomes quite rigid and stable since the entire weight is supported from the floor surface by the floor engaging means which due to its frictional resilient contact with the floor will provide stability against lateral or longitudinal movement of the wall.

In the operable wall system, single panels can be movably supported by the tracks for movement to a final position and the panel is then extended to remove the load from the track. This installation of the panels in a one by one sequence eliminates the necessity of the track supporting the entire wall.

Both embodiments of the invention compensate for changes or variations in the floor to ceiling dimension.

Frequently building settlement, snow loads, floor loads and other conditions may cause as much as a one to two inch variation in the floor to ceiling dimension, especially in large open span areas. The walls as disclosed will function effectively without buckling or binding even if such dimensional changes exist prior to or occur after installation.

In each embodiment of the invention, the force exerted on the ceiling surface by the ceiling engaging member 28 is adjusted and maintained constant and the adjustment of the bottom spring arrangement connected with the floor engaging member serving to support or counterbalance the weight of the panel 14 in a manner to compensate for variations in the floor-to-ceiling heights which may be encountered in typical building structures. By using the portable wall system, the panels may be installed between a floor and a suspended ceiling utilizing conventional T-bar support rails or grid structures employed in a conventional drop ceiling arrangement. The anchoring buttons 172 may be attached to the bottom flange 144 of the T-bars 142 by merely a twisting action and the portable wall panels quickly installed and extended in a desired position. The side edges of the panels may be provided with any suitable type of interengaging structure in order to maintain alignment of the panels. The operable wall structure or system, illustrated in FIGS. 7–10, requires the installation of the overhead trackway and support of the overhead trackway from an adequate overhead support. By installing the trackway in a desired grid pattern, or the like, the orientation of a plurality of panels may be easily obtained with the panels being completely suspended from the overhead trackway during movement from one position to another and the side edges of these panels may also be provided with any suitable interengaging structure to provide a desired continuity of seal as well as the alignment of the panels.

The vertical adjustment of the ceiling and floor engaging members and the spring biasing thereof enables the side edges of the panels 14 to be disposed in a true vertical orientation even though the floor or ceiling surface may not be level. In the portable wall system embodiment of the invention, the ball-type caster combined with the vertically retractable floor engaging member enables the panels to be easily rolled along the floor surface from one location to another and eliminates the use of separate conveying devices, carts, or the like, which are normally employed to transport such panels. This arrangement also eliminates the necessity of physically lifting and carrying the panels since the vertical shortening of the panels enables the panels to be rolled from one position to another while in substantially a vertical position. In the operable wall system embodiment of the invention, the overhead trackways provide support for the panels during movement and enable movement to a desired location and the vertical movement of the supporting disk in the trackway completely disengages the rigid components of the trackway from the rigid components of the panel, thereby isolating the panel from any vibration, noise, temperature difference, and the like, which may exist in the trackway as compared with the panel.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a movable wall system extending generally vertically between a floor and ceiling and including at least one wall panel, that improvement in which the wall panel includes a fixed vertical dimension slightly less than the distance between the floor to the ceiling, a longitudinally continuous floor engaging and seal means on the lower edge of said panel for vertical movement, means for selectively vertically extending and retracing said floor engaging means, a ceiling engaging means at the upper edge of the panel, and spring biased and guiding means connecting the ceiling engaging means with the upper edge of the panel and adjustment means for varying the position of said ceiling engaging means in relation to said spring biased means to provide an initial adjustment of the position of the ceiling engaging means to maintain a substantially constant spring force on the ceiling engaging means within the range of the adjustment means by initially adjusting the initial position of the ceiling engaging means to a point approximate its final position when the panel is in its floor to ceiling position, said extending and retracting means including means mounted on the panel and forming the sole means for lifting the entire weight of the panel and moving the ceiling engaging means into spring biased engagement with the ceiling with the weight of the panel maintaining the seal means in sealing engagement with the floor, said floor engaging and seal means being in the form of an elongated channel-shaped member having parallel legs telescopically receiving the surfaces of the panel, and adjustable spring biasing and guiding means interconnecting the channel-shaped member and the lower edge of the panel.

2. The structure as defined in claim 1 wherein said ceiling engaging means includes an inverted channel-shaped member having a pair of spaced parallel legs telescopically receiving the opposite surfaces of the upper edge of the panel.

3. The structure as defined in claim 1 wherein said ceiling engaging means includes upwardly extending support rods each having support means mounted thereon for engagement with an overhead track supported from the ceiling, said support means being movable vertically with the ceiling engaging means whereby the support means will be disengaged from the track and spaced above the supporting surfaces of the track when the ceiling engaging means is engaged with the ceiling surface, said support means being engageable with the supporting surfaces on the track when the vertical dimension of the panel is shortened thereby suspending the entire weight of the panel from the overhead track and enabling movement of the panel along the track.

4. In a movable wall system extending generally vertically between a floor and ceiling and including at least one wall panel, that improvement in which the wall panel includes a fixed vertical dimension slightly less than the distance between the floor to the ceiling, a longitudinally continuous floor engaging and seal means on the lower edge of said panel for vertical movement, means for selectively vertically extending and retracing said floor engaging means, a ceiling engaging means at the upper edge of the panel, and spring biased and guiding means connecting the ceiling engaging means with the upper edge of the panel with the spring biased means being adjustable to provide an initial adjustment of the position of the ceiling engaging means to maintain a substantially constant spring force on the ceiling engaging means within the range of the adjustment means by initially adjusting the initial position of the ceiling engaging means to a point approximate its final position when the panel is in its floor to ceiling position, said extending and retracting means including means mounted on the panel and forming the sole means for lifting the entire weight of the panel and moving the ceiling engaging means into spring biased engagement with the ceiling with the weight of the panel maintaining the seal means in sealing engagement with the floor, and said means for extending and retracting the floor engaging means includes a guide rod connected with the floor engaging means and a linkage assembly connected with the guide rod including a rotatable lever connected to the guide rod by a connecting link to cause reciprocation of the guide rod upon angular movement of the lever, means supporting said lever to move the connection between the lever and link to an over-center position with respect to the rotational axis of the lever to lock the floor engaging means in extended and retracted positions.

5. In a movable wall system extending generally vertically between a floor and ceiling and including at least one wall panel, that improvement in which the wall panel includes a fixed vertical dimension slightly less than the distance between the floor to the ceiling, a longitudinally continuous floor engaging and seal means on the lower edge of said panel for vertical movement, means for selectively vertically extending and retracting said floor engaging means, a ceiling engaging means at the upper edge of the panel, and spring biased and guiding means connecting the ceiling engaging means with the upper edge of the panel with the spring biased means being adjustable to provide an initial adjustment of the position of the ceiling engaging means to maintain a substantially constant spring force on the ceiling engaging means within the range of the adjustment means by initially adjusting the initial position of the ceiling engaging means to a point approximate its final position when the panel is in its floor to ceiling position, said extending and retracting means including means mounted on the panel and forming the sole means for lifting the entire weight of the panel and moving the ceiling engaging means into spring biased engagement with the ceiling with the weight of the panel maintaining the seal means in sealing engagement with the floor, said ceiling engaging means including an inverted channel-shaped member having a pair of spaced parallel legs telescopically receiving the opposite surfaces of the upper edge of the panel, and said adjustable biasing and guiding means including an elongated rod extending through and journaled in the bight portion of the channel-shaped member,a portion of said rod being externally threaded and the lower portion thereof being externally smooth, a floating guide block screw threaded onto the threaded portion of the rod, guide means in the panel for preventing rotation of the floating block but enabling vertical movement thereof, a stationary guide block in the panel in spaced relation to the floating guide block and including an aperture rotatably and reciprocally receiving the portion of the rod below the externally threaded portion thereof, a compression coil spring encircling the rod and interposed between the stationary block and floating block to bias the floating block, rod and channel-shaped member upwardly in relation to the panel, and means on the end of said rod accessible exteriorly of and above the bight portion of the channel-shaped member to enable rotatable adjustment of the threaded rod in relation to the floating block and adjust the initial position of the channel-shaped member whereby compression of the spring will enable the channel-shaped member to conform with variations in the floor-to-ceiling height with the initial adjustment of the channel-shaped member enabling the force necessary to further compress the spring during movement of the channel-shaped member to its final position to be a minimum and constant force exerted on the ceiling surface.

6. In a movable wall system extending generally vertically between a floor and ceiling and including at least one wall panel, that improvement in which the wall panel includes a fixed vertical dimension slightly less than the distance between the floor to the ceiling, a longitudinally continuous floor engaging and seal means on the lower edge of said panel for vertical movement, means for selectively vertically extending and retracting said floor engaging means, a ceiling engaging means at the upper edge of the panel, and spring biased and guiding means connecting the ceiling engaging means with the upper edge of the panel with the spring biased means being adjustable to provide an initial adjustment of the position of the ceiling engaging means to maintain a substantially constant spring force on the ceiling engaging means within the range of the adjustment means by initially adjusting the initial position of the ceiling engaging means to a point approximate its final position when the panel is in its floor to ceiling position, said extending and retracting means including means mounted on the panel and forming the sole means for lifting the entire weight of the panel and moving the ceiling engaging means into spring biased engagement with the ceiling with the weight of the panel maintaining the seal means in sealing engagement with the floor, wherein said ceiling engaging means includes upwardly extending support rods each having support means mounted thereon for engagement with an overhead track supported from the ceiling, said support means being movable vertically with the ceiling engaging means whereby the support means will be disengaged from the track and spaced above the supporting surfaces of the track when the ceiling engaging means is engaged with the ceiling surface, said support means being engageable with the supporting surfaces on the track when the vertical dimension of the panel is shortened thereby suspending the entire weight of the panel from the overhead track and enabling movement of the panel along the track, said means for extending and retracting the floor engaging means includes a guide rod connected with the floor engaging means and a linkage assembly connected with the guide rod including a rotatable lever connected to the guide rod by a connecting link to cause reciprocation of the guide rod upon angular movement of the lever, means supporting said lever to move the connection between the lever and link to an over-center position with respect to the rotational axis of the lever to lock the floor engaging means in extended and retracted positions.

7. The structure as defined in claim 6 wherein said ceiling engaging means includes an inverted channel-shaped member having a pair of spaced parallel legs telescopically receiving the opposite surfaces of the upper edge of the panel, and adjustable spring biased guide means interconnecting the channel-shaped member and panel to enable adjustment of the initial position of the channel-shaped member in relation to the panel, said adjustable biasing and guiding means including an elongated rod extending through and journaled in the bight portion of the channel-shaped member, a portion of said rod being externally smooth, a floating guide block screw threaded onto the threaded portion of the rod, guide means in the panel for preventing rotation of the floating block but enabling vertical movement thereof, a stationary guide block in the panel in spaced relation to the floating guide block and including an aperture rotatably and reciprocally receiving the portion of the rod below the externally threaded portion thereof, a compression coil spring encircling the rod and interposed between the stationary block and floating block to bias the floating block, rod and channel-shaped member upwardly in relation to the panel, and means on the end of said rod accessible exteriorly of and above the bight portion of the channel-shaped member to enable rotatable adjustment of the threaded rod in relation to the floating block and adjust the initial position of the channel-shaped member whereby compression of the spring will enable the channel-shaped member to conform with variations in the floor-to-ceiling height with the initial adjustment of the channel-shaped member enabling the force necessary to further compress the spring during movement of the channel-shaped member to its final position to be a minimum and constant force exerted on the ceiling surface.

* * * * *